US012606925B2

(12) United States Patent
Engelhardt et al.

(10) Patent No.: US 12,606,925 B2
(45) **Date of Patent: *Apr. 21, 2026**

(54) COMPOSITION FOR COPPER BUMP ELECTRODEPOSITION COMPRISING A LEVELING AGENT

(71) Applicant: BASF SE, Ludwigshafen am Rhein (DE)

(72) Inventors: Nadine Engelhardt, Ludwigshafen (DE); Alexander Fluegel, Ludwigshafen (DE); Marco Arnold, Ludwigshafen (DE); Charlotte Emnet, Ludwigshafen (DE)

(73) Assignee: BASF SE, Ludwigshafen am Rhein (DE)

( * ) Notice: Subject to any disclaimer, the term of this patent is extended or adjusted under 35 U.S.C. 154(b) by 1065 days.

This patent is subject to a terminal disclaimer.

(21) Appl. No.: 17/754,097

(22) PCT Filed: Sep. 15, 2020

(86) PCT No.: PCT/EP2020/075761

§ 371 (c)(1),
(2) Date: Mar. 23, 2022

(87) PCT Pub. No.: WO2021/058334

PCT Pub. Date: Apr. 1, 2021

(65) Prior Publication Data

US 2022/0333262 A1 Oct. 20, 2022

(30) Foreign Application Priority Data

Sep. 27, 2019 (EP) ..... 19200126

(51) Int. Cl.
*C25D 1/00* (2006.01)
*C25D 3/38* (2006.01)

(52) U.S. Cl.
CPC ..... *C25D 1/00* (2013.01); *C25D 3/38* (2013.01)

(58) Field of Classification Search
CPC ..... C25D 1/00; C25D 3/38
See application file for complete search history.

(56) References Cited

U.S. PATENT DOCUMENTS

| | | | | |
|---|---|---|---|---|
| 4,036,711 | A | 7/1977 | Kardos et al. | |
| 6,300,304 | B1 * | 10/2001 | Boeckh | C11D 3/0036 510/475 |
| 2012/0027948 | A1 | 2/2012 | Roeger-Goepfert et al. | |
| 2013/0020203 | A1 * | 1/2013 | Roeger-Goepfert | C08G 73/0206 205/261 |
| 2014/0238868 | A1 | 8/2014 | Li et al. | |
| 2014/0262800 | A1 * | 9/2014 | Kao | C25D 3/38 205/296 |
| 2015/0060132 | A1 | 3/2015 | Murakawa et al. | |

FOREIGN PATENT DOCUMENTS

| | | | |
|---|---|---|---|
| EP | 2547731 | A1 | 1/2013 |
| WO | 2010115757 | A1 | 10/2010 |
| WO | 2018146005 | A1 | 8/2018 |

OTHER PUBLICATIONS

European Search Report for EP Patent Application No. 19200126.1, Issued on Apr. 7, 2020, 4 pages.
International Search Report and Written Opinion for corresponding PCT/EP2020/075761 mailed Dec. 14, 2020; 9 pages.

* cited by examiner

*Primary Examiner* — Ciel P Contreras
(74) *Attorney, Agent, or Firm* — Armstrong Teasdale LLP

(57) ABSTRACT

Disclosed herein is a composition for copper bump electrodeposition including copper ions and at least one additive including a polyalkyleneimine backbone including N-hydrogen atoms, where (a) the polyalkyleneimine backbone has a mass average molecular weight Mw of from 900 g/mol to 100 000 g/mol,
(b) the N-hydrogen atoms are each substituted by a C2 to C6 polyoxyalkylene group, and
(c) the average number of oxyalkylene units in the polyoxyalkylene group is from more than 10 to less than 30 per N-hydrogen atoms in the polyalkyleneimine.

18 Claims, No Drawings

COMPOSITION FOR COPPER BUMP ELECTRODEPOSITION COMPRISING A LEVELING AGENT

CROSS-REFERENCE TO RELATED APPLICATIONS

This application is a U.S. National Phase Application of International Patent Application No. PCT/EP2020/075761, filed Sep. 15, 2020, which claims priority to European Patent Application No. 19200126.1, filed Sep. 27, 2019, each of which is hereby incorporated by reference herein.

BACKGROUND OF THE INVENTION

The invention relates to a copper electroplating composition comprising a polyethyleneimine leveling agent, its use and processes for copper bump electrodeposition.

Bumps are formed on a surface of a wafer having integrated circuits, such as LSIs. Such bumps constitute a part of interconnects of an integrated circuit and serve as terminals for connection to a circuit of an external package substrate (or a circuit substrate). The bumps are generally disposed along a periphery of a semiconductor chip (or die) and are connected to an external circuit by gold wires according to a wire bonding method or by leads according to a TAB method.

With the recent progress toward higher integration and higher density of semiconductor devices, the number of bumps for connection to external circuits is increasing, giving rise to the necessity to form bumps over the entire area of the surface of a semiconductor chip. Further, the need for shorter interconnect spacing has led to the use of a method (flip chip method) which involves flipping a semiconductor chip having a large number of bumps formed on its surface and connecting the bumps directly to a circuit substrate.

Electroplating is widely employed as a method of forming bumps. A process of forming bumps on a surface of a wafer having integrated circuits is one of the most important processes in a final stage of manufacturing of a semiconductor device. It is to be noted in this regard that an integrated circuit is formed on a wafer through many manufacturing processes. Therefore, very high reliability is required for a bump forming process which is performed on a wafer that has passed all the preceding processes. With the progress toward smaller-sized semiconductor chips, the number of bumps for connection to external circuits is increasing and bumps themselves are becoming smaller sized. Accordingly, a need exists to enhance the accuracy of positioning for bonding of a semiconductor chip to a circuit substrate such as a package substrate. In addition, there is a strong demand for no defect being produced in a bonding process in which bumps are melted and solidified.

Generally, copper bumps are formed on a seed layer of a wafer which is electrically connected to integrated circuits. A resist having openings is formed on a seed layer, and copper is deposited by copper electroplating on the exposed surface of the seed layer in the openings to thereby form copper bumps. The seed layer comprises a barrier layer, e.g. composed of titanium, to prevent diffusion of copper into the dielectric. After filling the openings in the resist with copper, the resist is removed, and then the copper bumps are subjected to reflow processing.

The need to fit more functional units into ever-tinier spaces drives the integrated circuit industry to bump processes for package connections. A second driver is to maximize the amount of input/output connections for a given area. With decreasing diameter of and distance between the bumps the connection density can be increased. These arrays are realized with copper bumps or μ-pillars on which a tin or tin alloy solder cap is plated. In order to assure that every bump is getting contacted across a wafer, besides a void-free deposition and reflow, uniform deposition height is needed.

Therefore, there is a need in the electronic industry for a copper electroplating bath which leads to bump deposit with a good morphology, particularly a low roughness, in combination with an improved uniformity in height, also called within die coplanarity (COP).

It is an object of the present invention to provide a copper electroplating composition that provides copper deposits showing a good morphology, particularly a low roughness and which is capable of filling recessed features on the micrometer scale without substantially forming defects, such as but not limited to voids. It is further an object of the present invention to provide a copper electroplating bath that provides a uniform and planar copper deposit, in particular in recessed features of 500 nanometers to 500 micrometers widths.

SUMMARY OF THE INVENTION

The present invention provides a composition comprising copper ions and at least one additive comprising a polyalkyleneimine backbone comprising N-hydrogen atoms, wherein (a) the polyalkyleneimine backbone has a mass average molecular weight $M_w$ of from 900 g/mol to 100 000 g/mol, (b) the N-hydrogen atoms are substituted by a polyoxyalkylene group comprising $C_2$ to $C_6$ oxyalkylene units, and (c) the average number of oxyalkylene units in the polyoxyalkylene group is of from more than 10 to less than 30 per N-hydrogen atom in the polyalkyleneimine.

The leveling agents according to the present invention are particularly useful for filling of recessed features having aperture sizes of 500 nm to 500 μm, particularly those having aperture sizes of 1 to 200 μm. The leveling agents are particularly useful for depositing copper bumps.

Due to the leveling effect of the leveling agents, surfaces are obtained with an improved coplanarity of the plated copper bumps. The copper deposits show a good morphology, particularly a low roughness. The electroplating composition is capable of filling recessed features on the micrometer scale without substantially forming defects, such as but not limited to voids.

Furthermore, the leveling agents according to the invention lead to reduced impurities, such as but not limited to organics, chloride, sulfur, nitrogen, or other elements. It shows large grains and an improved conductivity. It also facilitates high plating rates and allows plating at elevated temperature.

The invention further relates to the use of the aqueous composition as described herein for depositing copper on a substrate comprising a recessed feature comprising a conductive feature bottom and a dielectric feature side wall, wherein the recessed feature has an aperture size from 500 nm to 500 μm.

The invention further relates to a process for electrodepositing copper on a substrate comprising a recessed feature comprising a conductive feature bottom and a dielectric feature side wall, the process comprising:

a) contacting a composition as described herein with the substrate, and b) applying a current to the substrate for a time sufficient to deposit a copper layer into the recessed feature, wherein the recessed feature has an aperture size from 500 nm to 500 μm.

DETAILED DESCRIPTION OF THE INVENTION

As used herein, "recessed feature" or "feature" refers to the geometries on a substrate, such as, but not limited to, trenches and vias. "Apertures" refer to recessed features, such as vias and trenches. As used herein, the term "plating" refers to copper electroplating, unless the context clearly indicates otherwise. "Deposition" and "plating" are used interchangeably throughout this specification. The term "alkyl" means $C_1$ to $C_{20}$ alkyl and includes linear, branched and cyclic alkyl. As used herein "aryl" includes carbocyclic and heterocyclic aromatic systems, such as, but not limited to, phenyl, naphthyl, pyridyl, and the like. As used herein "$C_x$" refers to a group consisting of x carbon atoms. In the context of aryl, arylakyl and alkylaryl one or more carbon atoms may be substituted in the aryl part by heteroatoms, such as but not limited to O, S, and N (e.g. pyridine is a $C_6$ aryl in which one C atom is substituted by an N atom). As used herein "arylalkyl" means alkyl that is substituted by carbocyclic or heterocyclic aromatic systems, such as, but not limited to, benzyl, phenylethyl, naphthylmethyl, pyridylmethyl and the like. As used herein "alkylaryl" means alkyl substituted carbocyclic and heterocyclic aromatic systems, such as, but not limited to, methylphenyl, dimethylphenyl, ethylphenyl, methylnaphthyl, methylpyridyl and the like. As used herein "polymer" generally means any compound comprising at least two monomeric units i.e. the term polymer includes dimers, trimers, etc., oligomers as well as high molecular weight polymers. Preferably a polymer comprises 5 monomeric units or more, most preferably 10 monomeric units or more.

As used herein, "accelerator" refers to an organic additive that increases the plating rate of the electroplating bath. The terms "accelerator" and "accelerating agent" are used interchangeably throughout this specification. In literature, sometimes the accelerator component is also named "brightener" or "brightening agent". "Suppressor" refers to an organic compound that decreases the plating rate of the electroplating bath and ensures that the recessed features are voidless filled from the bottom to the top (so called "bottom-up filling"). The terms "suppressors" and "suppressing agents" are used interchangeably throughout this specification. "Leveler" refers to an organic compound that is capable of providing a substantially planar metal layer or a coplanar or uniform deposition height across the recessed features. The terms "levelers", "leveling agents" and "leveling additive" are used interchangeably throughout this specification.

"Aperture size" according to the present invention means the smallest diameter or free distance of a recessed feature before plating. The terms "width", "diameter", "aperture" and "opening" are used herein, depending on the geometry of the feature (trench, via, etc.) synonymously. As used herein, "aspect ratio" means the ratio of the depth to the aperture size of the recessed feature.

Leveling Agents According to the Invention

The present invention is achieved by combining one or more additives capable of providing a substantially planar copper layer and filling features without substantially forming defects, such as but not limited to voids, with a copper electroplating bath.

The additives (further also referred to as leveling agents) according to the present invention can be prepared by reacting a polyalkyleneimine backbone with one or more alkylene oxides to receive leveling agents that have a polyalkyleneimine backbone comprising N-hydrogen atoms, wherein (a) the polyalkyleneimine backbone has a mass average molecular weight $M_w$ of from 900 g/mol to 100 000 g/mol, (b) the N-hydrogen atoms are each substituted by a polyoxyalkylene group comprising $C_2$ to $C_6$ oxyalkylene units, and (c) the average number of oxyalkylene units in the polyoxyalkylene group is of from more than 10 to less than 30 per N-hydrogen atom in the polyalkyleneimine.

As used herein, "N-hydrogen atoms" means hydrogen atoms that are bonded to a nitrogen atom which are part of the polymer backbone of the polyalkyleneimine.

Polyalkyleneimine backbones are to be understood as meaning compounds which consist of a saturated hydrocarbon chain with terminal amino functions which is interrupted by secondary and tertiary amino group. Such backbones may be linear or branched. Different polyalkyleneimine backbones can of course be used in a mixture with one another. The mass average molecular weight $M_w$ of the levelling agent may be of from 900 g/mol to 100 000 g/mol. The molecular weight may be determined by size exclusion chromatography like GPC using polymethylmethacrylate (PMMA) as standard and hexafluoroisopropanol+0.05% potassium trifluoracetate as eluent.

The polyamine backbones may advantageously have the general formula L2a:

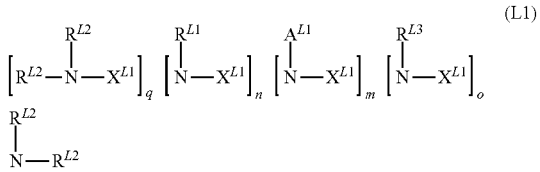

(L1)

Said backbones prior to subsequent modification comprise primary, secondary and tertiary amine nitrogen atoms connected by $X^{L1}$ "linking" units. Besides the terminating groups, the backbone comprises essentially three types of units, and it needs to be emphasized that these groups may be distributed along the backbone in any order.

The units which make up the polyalkyleneimine backbones are (a) primary units having the formula:

$[H_2N—X^{L1}]$— and —$NH_2$ which terminate the main backbone and any branching chains and which, after modification, have their two hydrogen atoms each substituted by one or more $C_2$ to $C_6$ oxyalkylene units, preferably oxyethylene units, oxypropylene units, oxybutylene units, and mixtures thereof; (b) secondary amine units having the formula:

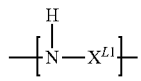

which, after modification, have their hydrogen atom substituted by oxyalkylene units, preferably oxyethylene units, oxypropylene units, oxybutylene units, and mixtures thereof; and (c) tertiary amine units having the formula:

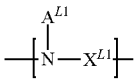

which are the branching points of the main and secondary backbone chains, $A^{L1}$ representing a continuation of the chain structure by branching. Continuation of the chain structure by branching here means that $A^{L1}$ may contain all primary, secondary and tertiary amine units described above except termination group $—N(R^{L2})_2$. The branching is the reason that q may be more than 1.

If m is 0, the polyethyleneimine backbone is a linear one, if only the main backbone but none of the side chains $A^{L1}$ contain any further tertiary amine units, comb-like backbone structures are formed, and if the side chains $A^{L1}$ contain further tertiary amine units, highly branched backbone structures are received. The tertiary units have no replaceable hydrogen atom and are therefore not modified by substitution with a polyoxyalkylene unit.

During the formation of the polyamine backbones cyclization may occur, therefore, an amount of cyclic polyamine may be present in the parent polyalkyleneimine backbone mixture. Each primary and secondary amine unit of the cyclic alkyleneimines undergoes modification by the addition of polyoxyalkylene units in the same manner as linear and branched polyalkyleneimines.

In formula L1 group $X^{L1}$ may be a linear $C_2$-$C_6$ alkanediyl, a branched $C_3$-$C_6$ alkanediyl, or mixtures thereof. A preferred branched alkanediyl is propanediyl. Most preferably $X^{L1}$ is ethanediyl or a combination of ethanediyl with propanediyl. The most preferred polyalkylene-imine backbone comprises groups $X^{L1}$ which are all ethanediyl units.

The lower limit of the weight average molecular weight $M_w$ of the polyalkyleneimine backbones is generally about 900 g/mol, preferably about 1 200 g/mol, more preferably about 1 500 g/mol. The upper limit of the weight average molecular weight $M_w$ is generally about 100 000 g/mol, preferably 75 000 g/mol, more preferably 25 000 g/mol, most preferably 10 000 g/mol. An example of a preferred weight average molecular weight range for the polyethyleneimine backbone is of from 900 to 6 000 g/mol, preferably of from 900 to 5 000 g/mol, more preferably of from 1 000 to 4 000 g/mol, most preferably of from 1 000 to 3 000 g/mol.

The indices n, m and o needed to achieve the preferred molecular weights will vary depending upon the $X^{L1}$ moiety in the backbone. n may be 1 or more, preferably 3 or more, most preferably 5 or more. m depends on the branching of the backbone and may be 0 or an integer of 1 or more. Preferably, the sum of q, n, m and o is from about 10 to about 2 400, more preferably from about 15 to about 1 000, even more preferably from about 20 to about 200, even more preferably from about 20 to about 100, most preferably from 22 to 70. For example, when $X^{L1}$ is ethanediyl a backbone unit averages 43 g/mol and when $X^{L1}$ is hexanediyl a backbone unit averages 99 g/mol.

The polyalkyleneimines of the present invention can be prepared, for example, by polymerizing ethyleneimine in the presence of a catalyst such as carbon dioxide, sodium bisulfite, sulfuric acid, hydrogen peroxide, hydrochloric acid, acetic acid, etc. Specific methods for preparing these polyalkyleneimine backbones are disclosed in U.S. Pat. Nos. 2,182,306, 3,033,746, 2,208,095, 2,806,839, and 2,553,696.

In addition, before the polyalkoxylation is performed, the polyalkyleneimine backbones may be partly substituted by groups $R^{L3}$ by alkylating agents. In this case o in formula L1 would be 1 or more. The groups $R^{L3}$ may be selected from a $C_1$ to $C_{12}$ alkyl, $C_2$ to $C_{12}$ alkenyl, $C_2$ to $C_{12}$ alkynyl, $C_6$ to $C_{20}$ alkylaryl, $C_6$ to $C_{20}$ arylalkyl, $C_6$ to $C_{20}$ aryl. Preferred groups $R^{L3}$ may be selected from a $C_1$ to $C_6$ alkyl, $C_6$ to $C_{12}$ alkylaryl, $C_6$ to $C_{12}$ arylalkyl, and $C_6$ to $C_{12}$ aryl. It is preferred that the aryl group is phenyl or naphthyl. The substitution by groups $R^{L3}$ would be performed before the polyalkoxylation of polyalkyleneimine. Also the terminating groups $[H_2N—X^{L1}]—$ and $—NH_2$ may be substituted by groups $R^{L3}$.

Suitable examples for alkylating agents are organic compounds which contain active halogen atoms, such as the arylalkyl halides, the alkyl, alkenyl and alkynyl halides, and the like. Additionally, compounds such as the alkyl sulfates, alkyl sultones, epoxides, and the like may also be used. Nonlimiting and examples of corresponding alkylating agents comprise benzyl chloride, propane sultone, dimethyl sulphate, (3-chloro-2-hydroxypropyl) trimethyl ammonium chloride, or the like. Preference is given to using dimethyl sulphate and/or benzyl chloride.

Preferably unsubstituted polyalkyleneimines are used before further polyalkoxylation with groups $R^{L1}$. In this case o in formula L1 would be 0.

The polyalkyleneimine backbones of the present invention are polyalkoxylated by substitution of the free (i.e. unsubstituted) N-hydrogen atom (also referred to as "N—H unit") with a $C_2$ to $C_6$ polyoxyalkylene group $R^{L1}$ having the formula $—(X^{L11}O)_pR^{L11}$ with $R^{L11}$=H, wherein $X^{L11}$ is each independently selected from a $C_2$ to $C_6$ alkanediyl. Such $C_2$ to $C_6$ alkanediyl may be linear or, for $C_3$ to $C_6$, branched.

In a preferred embodiment $X^{L11}$ is selected from ethane-1,2-diyl, propane-1,2-diyl, (2-hydroxymethyl)ethane-1,2-diyl, butane-1,2-diyl, butane-2,3-diyl, 2-methyl-propane-1,2-diyl (isobutylene), pentane-1,2-diyl, pentane-2,3-diyl, 2-methyl-butane-1,2-diyl, 3-methyl-butane-1,2-diyl, hexane-2,3-diyl, hexane-3,4-diyl, 2-methyl-pentane-1,2-diyl, 2-ethylbutane-1,2-diyl, 3-methyl-pentane-1,2-diyl, decane-1,2-diyl, 4-methyl-pentane-1,2-diyl and (2-phenyl)-ethane-1,2-diyl, and mixtures thereof.

In formula L1 p is an integer selected so that the average degree of alkoxylation, i.e. the arithmetic average of the oxyalkylene units over all the polyoxyalkylene groups $R^{L1}$ 1 to n ($1/n\Sigma_{n=1}{}^{n}p$), is a number from above 10 to below 30. Preferably the average degree of alkoxylation is 11 or more, preferably 12 or more, most preferably 13 or more. Preferably the average degree of alkoxylation is 29 or less, more preferably 28 or less, even more preferably 27 or less, even more preferably 26 or less, even more preferably 25 or less, even more preferably 24 or less, most preferably 23 or less. In a particular embodiment the average degree of alkoxylation may be chosen from a range of from 11 to 28, more preferably from 12 to 25, most preferably from 13 to 23.

Generally, the polyalkoxylation is performed by reacting the respective alkylene oxides with the polyethyleneimines. The synthesis of polyalkylene oxide groups is known to those skilled in the art. Comprehensive details are given, for example, in "Polyoxyalkylenes" in Ullmann's Encyclopedia of Industrial Chemistry, $6^{th}$ Edition, Electronic Release.

When two or more different alkylene oxides are used, the polyoxyalkylene groups formed may be random copolymers, gradient copolymers or block copolymers.

The modification of the N—H units in the polymer backbone with oxyalkylene units is carried out, for instance, by first reacting the polymer, preferably polyethyleneimine, with one or more alkylene oxides, preferably ethylene oxide, propylene oxide, or mixtures thereof, in the presence of up to 80% by weight of water at a temperature of from about 25 to about 150° C. in an autoclave fitted with a stirrer. In the first step of the reaction alkylene oxide is added in such an amount that nearly all hydrogen atoms of the N—H-units of the polyalkyleneimine are converted into hydroxyalkyl groups to give monoalkoxylated polyalkyleneimines. The water is then removed from the autoclave. After the addition of a basic catalyst, for example sodium methylate, potassium tertiary butylate, potassium hydroxide, sodium hydroxide, sodium hydride, potassium hydride or an alkaline ion exchanger in an amount of 0.1 to 15% by weight with reference to the addition product obtained in the first step of the alkoxylation, further amounts of alkylene oxide are added to the reaction product of the first step so that a polyalkoxylated polyalkyleneimine is obtained which contains the intended average number of alkylene oxide units per N—H unit of the polymer. A second step may be carried out for instance at temperatures of from about 60 to about 150° C. The second step of the alkoxylation may be carried out in an organic solvent such as xylene or toluene. For the correct metered addition of the alkylene oxides, it is advisable, before the alkoxylation, to determine the number of primary and secondary amine groups of the polyalkyleneimine.

The polyalkoxylated polyalkyleneimines may optionally be functionalized with groups $R^{L11}$ different from H in a further reaction step. An additional functionalization can serve to modify the properties of the polyalkoxylated polyalkyleneimines. To this end, the hydroxyl groups present in the polyoxyalkylated polyalkyleneimines are converted by means of suitable agents, which are capable of reaction with hydroxyl groups.

The type of functionalization depends on the desired end use. According to the functionalizing agent, the chain end can be hydrophobized or more strongly hydrophilized. However, it is preferred to use the alkoxylated polyalkyleneimines without any further functionalization, i.e. $R^{L11}$ is H.

The terminal hydroxyl groups may be esterified, for example, with sulfuric acid or derivatives thereof, so as to form products with terminal sulfate groups. Analogously, products having terminal phosphorus groups can be obtained with phosphoric acid, phosphorous acid, polyphosphoric acid, $POCl_3$ or $P_4O_{10}$.

In addition, the terminal hydroxyl groups may also be etherified, so as to form ether-terminated polyalkoxy groups, wherein $R^{L11}$ is selected from $C_1$ to $C_{12}$ alkyl, $C_2$ to $C_{12}$ alkenyl, $C_2$ to $C_{12}$ alkynyl, $C_6$ to $C_{18}$ arylalkyl, $C_5$ to $C_{12}$ aryl. Preferably, $R^{L11}$ may be methyl, ethyl or benzyl.

Finally, the amino groups present in the polyalkoxylated polyalkyleneimines may be protonated or quaternized by means of suitable alkylating agents. Examples for suitable alkylating agents are organic compounds which contain active halogen atoms, such as the arylalkyl halides, the alkyl, alkenyl and alkynyl halides, and the like. Additionally, compounds such as the alkyl sulfates, alkyl sultones, epoxides, and the like may also be used. Examples of corresponding alkylating agents comprise benzyl chloride, propane sultone, dimethyl sulphate, (3-chloro-2-hydroxypropyl) trimethyl ammonium chloride, or the like. Preference is given to using dimethyl sulphate and/or benzyl chloride.

A large variety of additives may typically be used in the bath to provide desired surface finishes for the Cu plated metal. Usually more than one additive is used with each additive forming a desired function. Advantageously, the electroplating baths may contain one or more of accelerators, suppressors, sources of halide ions, grain refiners and mixtures thereof. Most preferably the electroplating bath contains both, an accelerator and a suppressor in addition to the leveling agent according to the present invention.

Other Additives

A large variety of further additives may typically be used in the bath to provide desired surface finishes for the Cu plated metal. Usually more than one additive is used with each additive forming a desired function. Advantageously, the electroplating baths may contain one or more of accelerators, suppressors, sources of halide ions, grain refiners and mixtures thereof. Most preferably the electroplating bath contains both, an accelerator and a suppressing agent in addition to the leveling agent according to the present invention. Other additives may also be suitably used in the present electroplating baths.

Accelerators

Any accelerators may be advantageously used in the plating baths according to the present invention. As used herein, "accelerator" refers to an organic additive that increases the plating rate of the electroplating bath. The terms "accelerator" and "accelerating agent" are used interchangeably throughout this specification. In literature, sometimes the accelerator component is also named "brightener", "brightening agent", or "depolarizer". Accelerators useful in the present invention include, but are not limited to, compounds comprising one or more sulphur atom and a sulfonic/phosphonic acid or their salts. Preferably the composition further comprises at least one accelerating agent.

Preferred accelerators have the general structure $MO_3Y^A—X^{A1}—(S)_dR^{A2}$, with:

M is a hydrogen or an alkali metal, preferably Na or K;

$Y^A$ is P or S, preferably S;

d is an integer from 1 to 6, preferably 2;

$X^{A1}$ is selected from a $C_1$-$C_8$ alkanediyl or heteroalkanediyl group, a divalent aryl group or a divalent heteroaromatic group. Heteroalkyl groups will have one or more heteroatom (N, S, O) and 1-12 carbons. Carbocyclic aryl groups are typical aryl groups, such as phenyl or naphthyl. Heteroaromatic groups are also suitable aryl groups and contain one or more N, O or S atom and 1-3 separate or fused rings.

$R^{A2}$ is selected from H or (—S—$X^{A1'}Y^AO_3M$), wherein $X^{A1'}$ is independently selected from group $X^{A1}$.

More specifically, useful accelerators include those of the following formulae:

$$MO_3S—X^{A1}—SH$$

$$MO_3S—X^{A1}—S—S—X^{A1'}—SO_3M$$

$$MO_3S—Ar—S—S—Ar—SO_3M$$

wherein $X^{A1}$ is as defined above and Ar is aryl.

Particularly preferred accelerating agents are:

SPS: bis-(3-sulfopropyl)-disulfide

MPS: 3-mercapto-1-propansulfonic acid.

Both are usually applied in form of their salts, particularly their sodium salts.

Other examples of accelerators, used alone or in mixture, include, but are not limited to: MES (2-Mercaptoethanesulfonic acid, sodium salt); DPS (N,N-dimethyldithiocarbamic acid (3-sulfopropylester), sodium salt); UPS (3-[(amino-iminomethyl)-thio]-1-propylsulfonic acid); ZPS (3-(2-benzthiazolylthio)-1-propanesulfonic acid, sodium salt); 3-mercapto-propylsulfonic acid-(3-sulfopropyl)ester; methyl-($\overline{\omega}$-sulphopropyl)-disulfide, disodium salt; methyl-($\overline{\omega}$-sulphopropyl)-trisulfide, disodium salt.

Such accelerators are typically used in an amount of about 0.1 ppm to about 3000 ppm, based on the total weight of the plating bath. Particularly suitable amounts of accelerator useful in the present invention are 1 to 500 ppm, and more particularly 2 to 100 ppm.

Suppressing Agents

Suppressing agents may advantageously used in combination with the levelers according to the present inventions. As used herein, "suppressing agents" are additives which increase the overpotential during electrodeposition. There terms "surfactant" and "suppressing agent" are synonymously used since the suppressing agents described herein are also surface-active substances.

Particularly useful suppressing agents are:

(a) Suppressing agents obtainable by reacting an amine compound comprising at least three active amino functional groups with a mixture of ethylene oxide and at least one compound selected from $C_3$ and $C_4$ alkylene oxides as described in WO 2010/115796.

Preferably the amine compound is selected from diethylene triamine, 3-(2-aminoethyl)aminopropylamine, 3,3'-iminodi(propylamine), N,N-bis(3-aminopropyl)methylamine, bis(3-dimethylaminopropyl)amine, triethylenetetraamine and N,N'-bis(3-aminopropyl)ethylenediamine.

(b) Suppressing agents obtainable by reacting an amine compound comprising active amino functional groups with a mixture of ethylene oxide and at least one compound selected from $C_3$ and $C_4$ alkylene oxides, said suppressing agent having a molecular weight $M_w$ of 6000 g/mol or more, forming an ethylene $C_3$ and/or $C_4$ alkylene random copolymer as described in WO 2010/115756.

(c) Suppressing agent obtainable by reacting an amine compound comprising at least three active amino functional groups with ethylene oxide and at least one compound selected from $C_3$ and $C_4$ alkylene oxides from a mixture or in sequence, said suppressing agent having a molecular weight $M_w$ of 6000 g/mol or more as described in WO 2010/115757.

Preferably the amine compound is selected from ethylene diamine, 1,3-diaminopropane, 1,4-diaminobutane, 1,5-diaminopentane, 1,6-diaminohexane, neopentanediamine, isophoronediamine, 4,9-dioxadecane-1,12-diamine, 4,7,10-trioxyatridecane-1,13-diamine, triethylene glycol diamine, diethylene triamine, (3-(2-aminoethyl)aminopropylamine, 3,3'-iminodi(propylamine), N,N-bis(3-aminopropyl)methylamine, bis(3-dimethylaminopropyl)amine, triethylenetetraamine and N,N'-bis(3-aminopropyl)ethylenediamine.

(d) Suppressing agent selected from compounds of formula S1

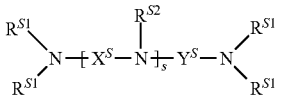

(S1)

wherein the $R^{S1}$ radicals are each independently selected from a copolymer of ethylene oxide and at least one further $C_3$ to $C_4$ alkylene oxide, said copolymer being a random copolymer, the $R^{S2}$ radicals are each independently selected from $R^{S1}$ or alkyl, $X^S$ and $Y^S$ are spacer groups independently, and $X^S$ for each repeating unit s independently, selected from $C_2$ to $C_6$ alkandiyl and $Z^S$—(O—$Z^S$)$_t$ wherein the $Z^S$ radicals are each independently selected from $C_2$ to $C_6$ alkandiyl, s is an integer equal to or greater than 0, and t is an integer equal to or greater than 1, as described in WO 2010/115717.

Preferably spacer groups $X^S$ and $Y^S$ are independently, and $X^S$ for each repeating unit independently, selected from $C_2$ to $C_4$ alkylene. Most preferably $X^S$ and $Y^S$ are independently, and $X^S$ for each repeating unit s independently, selected from ethylene (—$C_2H_4$—) or propylene (—$C_3H_6$—).

Preferably $Z^S$ is selected from $C_2$ to $C_4$ alkylene, most preferably from ethylene or propylene.

Preferably s is an integer from 1 to 10, more preferably from 1 to 5, most preferably from 1 to 3. Preferably t is an integer from 1 to 10, more preferably from 1 to 5, most preferably from 1 to 3.

In another preferred embodiment the $C_3$ to $C_4$ alkylene oxide is selected from propylene oxide (PO). In this case EO/PO copolymer side chains are generated starting from the active amino functional groups The content of ethylene oxide in the copolymer of ethylene oxide and the further $C_3$ to $C_4$ alkylene oxide can generally be from about 5% by weight to about 95% by weight, preferably from about 30% by weight to about 70% by weight, particularly preferably between about 35% by weight to about 65% by weight.

The compounds of formula (S1) are prepared by reacting an amine compound with one ore more alkylene oxides. Preferably the amine compound is selected from ethylene diamine, 1,3-diaminopropane, 1,4-diaminobutane, 1,5-diaminopentane, 1,6-diaminohexane, neopentanediamine, isophoronediamine, 4,9-dioxadecane-1,12-diamine, 4,7,10-trioxatridecane-1,13-diamine, triethylene glycol diamine, diethylene triamine, (3-(2-aminoethyl)amino)propylamine, 3,3'-iminodi(propylamine), N,N-bis(3-aminopropyl)methylamine, bis(3-dimethylaminopropyl)amine, triethylenetetraamine and N,N'-bis(3-aminopropyl)ethylene-diamine.

The molecular weight $M_w$ of the suppressing agent of formula S1 may be between about 500 g/mol to about 30000 g/mol. Preferably the molecular weight $M_w$ should be about 6000 g/mol or more, preferably from about 6000 g/mol to about 20000 g/mol, more preferably from about 7000 g/mol to about 19000 g/mol, and most preferably from about 9000 g/mol to about 18000 g/mol. Preferred total amounts of alkylene oxide units in the suppressing agent may be from about 120 to about 360, preferably from about 140 to about 340, most preferably from about 180 to about 300.

Typical total amounts of alkylene oxide units in the suppressing agent may be about 110 ethylene oxide units (EO) and 10 propylene oxide units (PO), about 100 EO and 20 PO, about 90 EO and 30 PO, about 80 EO and 40 PO, about 70 EO and 50 PO, about 60 EO and 60 PO, about 50 EO and 70 PO, about 40 EO and 80 PO, about 30 EO and 90 PO, about 100 EO and 10 butylene oxide (BO) units, about 90 EO and 20 BO, about 80 EO and 30 BO, about 70 EO and 40 BO, about 60 EO and 50 BO or about 40 EO and 60 BO to about 330 EO and 30 PO units, about 300 EO and 60 PO, about 270 EO and 90 PO, about 240 EO and 120 PO, about 210 EO and 150 PO, about 180 EO and 180 PO, about 150 EO and 210 PO, about 120 EO and 240 PO, about 90 EO and 270 PO, about 300 EO and 30 BO units, about 270 EO and 60 BO, about 240 EO and 90 BO, about 210 EO and 120 BO, about 180 EO and 150 BO, or about 120 EO and 180 BO.

(e) Suppressing agent obtainable by reacting a polyhydric alcohol condensate compound derived from at least one polyalcohol of formula (S2) $X^S(OH)_u$ by condensation with at least one alkylene oxide to form a polyhydric alcohol condensate comprising polyoxyalkylene side chains, wherein u is an integer from 3 to 6 and $X^S$ is an u-valent linear or branched aliphatic or cycloaliphatic radical having from 3 to 10 carbon atoms, which may be substituted or unsubstituted, as described in WO 2011/012462.

Preferred polyalcohol condensates are selected from compounds of formulae (S2a)

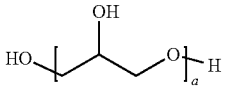

(S2b)

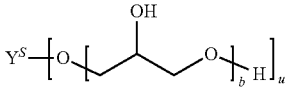

(S3c)

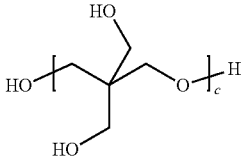

wherein $Y^S$ is an u-valent linear or branched aliphatic or cycloaliphatic radical having from 1 to 10 carbon atoms, which may be substituted or unsubstituted, a is an integer from 2 to 50, b may be the same or different for each polymer arm u and is an integer from 1 to 30, c is an integer from 2 to 3, and u is an integer from 1 to 6. Most preferred Polyalcohols are glycerol condensates and/or pentaerythritol condensates.

(f) Suppressing agent obtainable by reacting a polyhydric alcohol comprising at least 5 hydroxyl functional groups with at least one alkylene oxide to form a polyhydric alcohol comprising polyoxyalkylene side chains as described in WO 2011/012475. Preferred polyalcohols are linear or cyclic monosaccharide alcohols represented by formula (S3a) or (S3b)

$$HOCH_2—(CHOH)_v—CH_2OH \quad (S3a)$$

$$(CHOH)_w \quad (S3b)$$

wherein v is an integer from 3 to 8 and w is an integer from 5 to 10. Most preferred monosaccharide alcohols are sorbitol, mannitol, xylitol, ribitol and inositol. Further preferred polyalcohols are monosaccharides of formula (S4a) or (S4b)

$$CHO—(CHOH)_x—CH_2OH \quad (S4a)$$

$$CH_2OH—(CHOH_y—CO—(CHOH)_z—CH_2OH \quad (S4b)$$

wherein x is an integer of 4 to 5, and y, z are integers and y+z is 3 or 4. Most preferred monosaccharide alcohols are selected from the aldoses allose, altrose, galactose, glucose, gulose, idose, mannose, talose, glucoheptose, mannoheptose or the ketoses fructose, psicose, sorbose, tagatose, mannoheptulose, sedoheptulose, taloheptulose, alloheptulose.

(g) amine-based polyoxyalkylene suppressing agents based on cyclic amines show extraordinary superfilling properties, as described in WO 2018/073011.

(h) polyamine-based or polyhydric alcohol-based suppressing agents which are modified by reaction with a compound, such as but not limited to glycidole or glycerol carbonate, that introduce a branching group into the suppressing agent before they are reacted with alkylene oxides show extraordinary superfilling properties, as described in WO 2018/114985.

When suppressors are used, they are typically present in an amount in the range of from about 1 to about 10,000 ppm based on the weight of the bath, and preferably from about 5 to about 10,000 ppm.

It will be appreciated by those skilled in the art that more than one leveling agent may be used. When two or more leveling agents are used, at least one of the leveling agents is a leveling agent according to the invention or a derivative thereof as described herein. It is preferred to use only one leveling agent in the plating composition.

Further Leveling Agents

Additional leveling agents can advantageously be used in the copper electroplating baths according to the present invention. When two or more leveling agents are used, at least one of the leveling agents is a polyalkoxylated polyalkyleneimine or a derivative thereof as described herein. It is preferred to use only one leveling agent in the plating composition that is a polyalkoxylated polyalkylenepolyamine according to the invention.

Suitable additional leveling agents include, but are not limited to, one or more of other polyethylene imines and derivatives thereof, quaternized polyethylene imines, polyglycine, poly(allylamine), polyaniline, polyurea, polyacrylamide, poly(melamine-co-formaldehyde), reaction products of amines with epichlorohydrin, reaction products of an amine, epichlorohydrin, and polyalkylene oxide, reaction products of an amine with a polyepoxide, polyvinylpyridine, polyvinylimidazole as described e.g. in WO 2011/151785 A1, polyvinylpyrrolidone, polyaminoamides as described e.g. in WO 2011/064154 A2 and WO 2014/072885 A2, or copolymers thereof, nigrosines, pentamethylpara-rosaniline hydrohalide, hexamethyl-pararosaniline hydrohalide, di- or trialkanolamines and their derivatives as described in WO 2010/069810, biguanides as described in WO 2012/085811 A1, or a compound containing a functional group of the formula N—R—S, where R is a substituted alkyl, unsubstituted alkyl, substituted aryl or unsubstituted aryl. Typically, the alkyl groups are $C_1$-$C_6$ alkyl and preferably $C_1$-$C_4$ alkyl. In general, the aryl groups include $C_6$-$C_{20}$ aryl, preferably $C_6$-$C_{10}$ aryl. It is preferred that the aryl group is phenyl or naphthyl. The compounds containing a functional group of the formula N—R—S are generally known, are generally commercially available and may be used without further purification.

In such compounds containing the N—R—S functional group, the sulfur ("S") and/or the nitrogen ("N") may be attached to such compounds with single or double bonds. When the sulfur is attached to such compounds with a single bond, the sulfur will have another substituent group, such as but not limited to hydrogen, $C_1$-$C_{12}$ alkyl, $C_2$-$C_{12}$ alkenyl, $C_6$-$C_{20}$ aryl, $C_1$-$C_{12}$ alkylthio, $C_2$-$C_{12}$ alkenylthio, $C_6$-$C_{20}$ arylthio and the like. Likewise, the nitrogen will have one or more substituent groups, such as but not limited to hydrogen, $C_1$-$C_{12}$ alkyl, $C_2$-$C_{12}$ alkenyl, $C_7$-$C_{10}$ aryl, and the like.

The N—R—S functional group may be acyclic or cyclic. Compounds containing cyclic N—R—S functional groups include those having either the nitrogen or the sulfur or both the nitrogen and the sulfur within the ring system.

In general, the total amount of leveling agents in the electroplating bath is from 0.5 ppm to 10000 ppm based on the total weight of the plating bath. The leveling agents according to the present invention are typically used in a total amount of from about 0.1 ppm to about 1000 ppm based on the total weight of the plating bath and more typically from 1 to 100 ppm, although greater or lesser amounts may be used.

More details and alternatives are described in WO 2018/219848, WO 2016/020216, and WO 2010/069810, respectively, which are incorporated herein by reference.

In general, the total amount of leveling agents in the electroplating bath is from 0.5 ppm to 10000 ppm based on the total weight of the plating bath. The leveling agents according to the present invention are typically used in a total amount of from about 100 ppm to about 10000 ppm based on the total weight of the plating bath, although greater or lesser amounts may be used.

Electrolyte

The copper ion source may be any compound capable of releasing metal ions to be deposited in the electroplating bath in sufficient amount, i.e. is at least partially soluble in the electroplating bath. It is preferred that the metal ion source is soluble in the plating bath. Suitable metal ion sources are metal salts and include, but are not limited to, metal sulfates, metal halides, metal acetates, metal nitrates, metal fluoroborates, metal alkylsulfonates, metal arylsulfonates, metal sulfamates, metal gluconates and the like.

The metal ion source may be used in the present invention in any amount that provides sufficient metal ions for electroplating on a substrate. When the metal is solely copper, it is typically present in an amount in the range of from about 1 to about 300 g/l of plating solution.

In another preferred embodiment the plating solution is essentially free of tin, that is, they contain 1% by weight tin, more preferably below 0.1% by weight, and yet more preferably below 0.01% by weight, and still more preferably are free of copper. In another preferred embodiment the plating solution is essentially free of any alloying metal, that is, they contain 1% by weight tin, more preferably below 0.1% by weight, even more preferably below 0.01% by weight, and still more preferably are free of tin. Most preferably the metal consists of copper.

Optionally, the plating baths according to the invention may contain one or more alloying metal ions up to an amount of 10% by weight, preferably up to 5% by weight, most preferably up to 2% by weight. Suitable alloying metals include, without limitation, silver, gold, tin, bismuth, indium, zinc, antimony, manganese and mixtures thereof. Preferred alloying metals are silver, tin, bismuth, indium, and mixtures thereof, and more preferably tin. Any bath-soluble salt of the alloying metal may suitably be used as the source of alloying metal ions. Examples of such alloying metal salts include, but are not limited to: metal oxides; metal halides; metal fluoroborate; metal sulfates; metal alkanesulfonates such as metal methanesulfonate, metal ethanesulfonate and metal propanesulfonate; metal arylsulfonates such as metal phenylsulfonate, metal toluenesulfonate, and metal phenolsulfonate; metal carboxylates such as metal gluconate and metal acetate; and the like. Preferred alloying metal salts are metal sulfates; metal alkanesulfonates; and metal arylsulfonates. When one alloying metal is added to the present compositions, a binary alloy deposit is achieved. When 2, 3 or more different alloying metals are added to the present compositions, tertiary, quaternary or higher order alloy deposits are achieved. The amount of such alloying metal used in the present compositions will depend upon the particular tin-alloy desired. The selection of such amounts of alloying metals is within the ability of those skilled in the art. It will be appreciated by those skilled in the art that when certain alloying metals, such as silver, are used, an additional complexing agent may be required. Such complexing agents (or complexers) are well-known in the art and may be used in any suitable amount to achieve the desired tin-alloy composition.

The present electroplating compositions are suitable for depositing a copper-containing layer, which may preferably be a pure copper layer or alternatively a copper alloy layer comprising up to 10% by weight, preferably up to 5% by weight, most preferably up to 2% by weight of the alloying metal(s). Exemplary copper alloy layers include, without limitation, tin-silver, tin-copper, tin-indium, tin-bismuth, tin-silver-copper, tin-silver-copper-antimony, tin-silver-copper-manganese, tin-silver-bismuth, tin-silver-indium, tin-silver-zinc-copper, and tin-silver-indium-bismuth. Preferably, the present electroplating compositions deposit pure tin, tin-silver, tin-silver-copper, tin-indium, tin-silver-bismuth, tin-silver-indium, and tin-silver-indium-bismuth, and more preferably pure tin, tin-silver or tin-copper.

The alloy metal content may be measured by either atomic adsorption spectroscopy (AAS), X-ray fluorescence (XRF), inductively coupled plasma mass spectrometry (ICP-MS).

In general, besides the copper ions and at least one of the leveling agents, the present copper electroplating compositions preferably include an electrolyte, i. e. acidic or alkaline electrolyte, optionally halide ions, and optionally other additives like accelerators and suppressing agents. Such baths are typically aqueous.

In general, as used herein "aqueous" means that the present electroplating compositions comprises a solvent comprising at least 50% of water. Preferably, "aqueous" means that the major part of the composition is water, more preferably 90% of the solvent is water, most preferably the solvent consists or essentially consists of water. Any type of water may be used, such as distilled, deinonized or tap.

Preferably, the plating baths of the invention are acidic, that is, they have a pH below 7. Typically, the pH of the copper electroplating composition is below 4, preferably below 3, most preferably below 2.

The electroplating baths of the present invention may be prepared by combining the components in any order. It is preferred that the inorganic components such as metal salts, water, electrolyte and optional halide ion source, are first added to the bath vessel followed by the organic components such as accelerators, suppressing agents, leveling agents, and the like.

Suitable electrolytes include such as, but not limited to, sulfuric acid, acetic acid, fluoroboric acid, alkylsulfonic acids such as methanesulfonic acid, ethanesulfonic acid, propanesulfonic acid and trifluoromethane sulfonic acid, arylsulfonic acids such as phenyl sulfonic acid and toluenesulfonic acid, sulfamic acid, hydrochloric acid, phosphoric acid, tetraalkylammonium hydroxide, preferably tetramethylammonium hydroxide, sodium hydroxide, potassium hydroxide and the like. Acids are typically present in an amount in the range of from about 1 to about 300 g/l. In one embodiment the at least one additive comprises a counterion $Y^{o-}$ selected from methane sulfonate, sulfate or acetate, wherein o is a positive integer.

Such electrolytes may optionally (and preferably) contain a source of halide ions, such as chloride ions as in copper chloride or hydrochloric acid. A wide range of halide ion concentrations may be used in the present invention such as from about 0 to about 500 ppm. Preferably, the halide ion concentration is in the range of from about 10 to about 100 ppm based on the plating bath. It is preferred that the electrolyte is sulfuric acid or methanesulfonic acid, and preferably a mixture of sulfuric acid or methanesulfonic acid and a source of chloride ions. The acids and sources of halide ions useful in the present invention are generally commercially available and may be used without further purification.

Process

The composition according to the invention is particularly useful for electrodepositing copper on a substrate comprising a recessed feature comprising a conductive feature bottom and a dielectric feature side wall, wherein the recessed feature has an aperture size from 500 nm to 500 μm. The leveling agents according to the present invention are particularly useful for filling of recessed features having aperture sizes of 1 to 200 μm. The leveling agents are particularly useful for depositing copper bumps.

The copper is deposited in recesses according to the present invention without substantially forming voids within the metal deposit. By the term "without substantially forming voids", it is meant that there are no voids in the metal deposit which are bigger than 1000 nm, preferably no voids in the metal deposit which are bigger than 500 nm, most preferably no voids in the metal deposit which are bigger than 100 nm. Most preferably the deposit is free of any defects.

Due to the leveling effect of the leveling agents, surfaces are obtained with an improved coplanarity of the plated copper bumps. The copper deposits show a good morphology, particularly a low roughness. The electroplating composition is capable of filling recessed features on the micrometer scale without substantially forming defects, such as but not limited to voids.

Furthermore, the leveling agents according to the invention lead to reduced impurities, such as but not limited to organics, chloride, sulfur, nitrogen, or other elements. It shows large grains and an improved conductivity. It also facilitates high plating rates and allows plating at elevated temperature.

In general, when the present invention is used to deposit copper on a substrate the plating baths are agitated during use. Any suitable agitation method may be used with the present invention and such methods are well-known in the art. Suitable agitation methods include, but are not limited to, inert gas or air sparging, work piece agitation, impingement and the like. Such methods are known to those skilled in the art. When the present invention is used to plate an integrated circuit substrate, such as a wafer, the wafer may be rotated such as from 1 to 150 RPM and the plating solution contacts the rotating wafer, such as by pumping or spraying. In the alternative, the wafer need not be rotated where the flow of the plating bath is sufficient to provide the desired metal deposit.

Plating equipments for plating semiconductor substrates are well known. Plating equipment comprises an electroplating tank which holds copper electrolyte and which is made of a suitable material such as plastic or other material inert to the electrolytic plating solution. The tank may be cylindrical, especially for wafer plating. A cathode is horizontally disposed at the upper part of tank and may be any type substrate such as a silicon wafer having openings.

These additives can be used with soluble and insoluble anodes in the presence or absence of a membrane or membranes separating the catholyte from the anolyte.

The cathode substrate and anode are electrically connected by wiring and, respectively, to a power supply. The cathode substrate for direct or pulse current has a net negative charge so that the metal ions in the solution are reduced at the cathode substrate forming plated metal on the cathode surface. An oxidation reaction takes place at the anode. The cathode and anode may be horizontally or vertically disposed in the tank.

In general, when preparing copper bumps, a photoresist layer is applied to a semiconductor wafer, followed by standard photolithographic exposure and development techniques to form a patterned photoresist layer (or plating mask) having recessed features or vias therein. The dimensions of the dielectric plating mask (thickness of the plating mask and the size of the openings in the pattern) defines the size and location of the copper layer deposited over the I/O pad and UBM. The diameter of such deposits typically range of from 1 to 300 μm, preferably in the range from 2 to 100 μm. Usually the recesses provided by the plating mask are not fully but only partly filled. After filling the openings in the plating mask with copper, the plating mask is removed, and then the copper bumps are usually subjected to reflow processing.

Typically, the plating baths of the present invention may be used at any temperature from 10 to 65 degrees C. or higher. It is preferred that the temperature of the plating baths is from 10 to 35 degrees C. and more preferably from 15 degrees to 30 degrees C.

All percent, ppm or comparable values refer to the weight with respect to the total weight of the respective composition except where otherwise indicated. All cited documents are incorporated herein by reference.

The following examples shall further illustrate the present invention without restricting the scope of this invention.

Analytical Methods

The molecular weight of the leveling agents was determined by size-exclusion chromatography (SEC). Polystyrene was used as standard and tetrahydrofuran as effluent. The temperature of the column was 30° C., the injected volume 30 μl (microliter) and the flow rate 1.0 ml/min. The weight average molecular weight ($M_w$), the number average molecular weight ($M_n$) and the polydispersity PDI ($M_w/M_n$) of the suppressing agent were determined.

The amine number was determined according to DIN 53176 by titration of a solution of the polymer in acetic acid with perchloric acid.

The experiments were performed by using a 300 mm silicon wafer segment with a patterned photoresist 120 μm thick and a plurality of copper seeded 75 micrometers opening vias (available from IMAT, Inc., Vancouver, WA, USA).

The electroplated copper was investigated by a 3D laser scanning microscope (3D LSM). The height of the deposited copper layer in the bumps was determined visually.

The non-uniformity was determined from heights of totally 27 measured bumps, where 15 bumps in the dense area with a pitch size of 150 μm and 12 bumps with a pitch size of 375 μm were measured.

The coplanarity, an indicator of non-uniformity, was calculated from the heights by using the following formula:

$$COP\ [\%] = \frac{\text{bump height average } iso - \text{bump height average dense}}{\text{mean height}} \times 100$$

wherein "bump height average iso" and "bump height average dense" are the arithmetic mean of each area. "mean height" is calculated by the sum of "bump height average iso" and "bump height average dense" divided by 2.

EXAMPLES

Example 1: Leveler Preparation

Synthesis of Intermediate Compound A: PE11300+1 EO/NH

Polyethyleneimine (Lupasol G20 from BASF) (430.4 g) was placed into a 3.5 l autoclave at 80° C. and the reactor was purged with nitrogen three times at 1.5 bar. Then, ethylene oxide (440.5 g) was added in portions at 100° C. over a period of 10 h, reaching a maximum pressure of 5 bar. To complete the reaction, the mixture was allowed to post-react for 6 h at 100° C. at a pressure of 2 bar. Then, the temperature was decreased to 80° C. and volatile compounds were removed in vacuum at 80° C. A brown viscous liquid was observed (769.2 g) with an amine number of 538.7 mg/g.

Comparative Example 1.1

Intermediate Compound A (125 g) and potassium tert-butoxide (0.9 g) were placed into a 3.5 l autoclave at 80° C. and the reactor was purged with nitrogen three times at 1.5 bar. Then, ethylene oxide (475.7 g) was added in portions at 100° C. over a period of 10 h, reaching a maximum pressure of 5 bar. To complete the reaction, the mixture was allowed to post-react for 6 h at 100° C. at a pressure of 2 bar. Then, the temperature was decreased to 80° C. and volatile compounds were removed in vacuum at 80° C. A brown viscous liquid was observed (576.2 g) with an amine number of 118.5 mg/g.

Example 1.2

Intermediate Compound A (104.2 g) and potassium tert-butoxide (1.08 g) were placed into a 3.5 l autoclave at 80° C. and the reactor was purged with nitrogen three times at 1.5 bar. Then, ethylene oxide (616.7 g) was added in portions at 100° C. over a period of 10 h, reaching a maximum pressure of 5 bar. To complete the reaction, the mixture was allowed to post-react for 6 h at 100° C. at a pressure of 2 bar. Then, the temperature was decreased to 80° C. and volatile compounds were removed in vacuum at 80° C. A brown viscous liquid was observed (703.2 g) with an amine number of 78.8 mg/g.

Example 1.3

Intermediate Compound A (104.2 g) and potassium tert-butoxide (1.08 g) were placed into a 3.5 l autoclave at 80° C. and the reactor was purged with nitrogen three times at 1.5 bar. Then, ethylene oxide (836.9 g) was added in portions at 100° C. over a period of 10 h, reaching a maximum pressure of 5 bar. To complete the reaction, the mixture was allowed to post-react for 6 h at 100° C. at a pressure of 2 bar. Then, the temperature was decreased to 80° C. and volatile compounds were removed in vacuum at 80° C. A brown viscous liquid was observed (923.9 g) with an amine number of 59.9 mg/g.

Example 2: Copper Electroplating

Comparative Example 2.1

A copper electroplating bath containing 51 g/l Cu ions, 100 g/l sulfuric acid and 50 ppm chloride has been used for the studies. In addition, the bath contains the following additives 50 ppm SPS, 100 ppm of an ethylene oxide polymer with an average molecular weight of 4000 g/mol and 20 ppm of comparative example 1.1.

The substrate is prewetted and electrically contacted prior plating. The copper layer was plated by using a bench top plating tool available from Yamamoto MS. The electrolyte convection was realized by a pump and a paddle in front of the substrate. The RPM of the paddle for all plating conditions were 50 RPM. Bath temperature was controlled and set to 25° C. and the applied current density was 4 ASD for 340 s and 8 ASD for 1875 s resulting in bumps of approximately 50 μm height.

The plated bumps were examined with an LSM as described in detail above. A coplanarity (COP) of 11.5% was determined.

The results are summarized in Table 1

Example 2.2

A copper electroplating bath containing 51 g/l Cu ions, 100 g/l sulfuric acid and 50 ppm chloride has been used for the studies. In addition, the bath contains the following additives 50 ppm SPS, 100 ppm of an ethylene oxide polymer with an average molecular weight of 4000 g/mol and 20 ppm of example 1.2.

The substrate is prewetted and electrically contacted prior plating. The copper layer was plated by using a bench top plating tool available from Yamamoto MS. The electrolyte convection was realized by a pump and a paddle in front of the substrate. The RPM of the paddle for all plating conditions were 50 RPM. Bath temperature was controlled and set to 25° C. and the applied current density was 4 ASD for 340 s and 8 ASD for 1875 s resulting in bumps of approximately 50 μm height.

The plated bumps were examined with an LSM as described in detail above. A coplanarity (COP) of 9.0% was determined.

The results are summarized in Table 1.

Example 2.3

A copper electroplating bath containing 51 g/l Cu ions, 100 g/l sulfuric acid and 50 ppm chloride was used for the studies. In addition, the bath contained the following additives: 50 ppm SPS, 100 ppm of an ethylene oxide polymer with an average molecular weight of 4000 g/mol and 20 ppm of example 1.3.

The substrate is prewetted and electrically contacted prior plating. The copper layer was plated by using a bench top plating tool available from Yamamoto MS. The electrolyte convection was realized by a pump and a paddle in front of the substrate. The RPM of the paddle for all plating conditions were 50 RPM. Bath temperature was controlled and set to 25° C. and the applied current density was 4 ASD for 340 s and 8 ASD for 1875 s resulting in bumps of approximately 50 μm height.

The plated bumps were examined with an LSM as described in detail above. A coplanarity (COP) 9.0% was determined.

The results are summarized in Table 1.

Comparing the results of comparative example Examples 2.1 with examples 2.2 and 2.3 the copper electroplating leads to a significantly better coplanarity when using the leveler with a higher degree of alkoxylation of examples 2.2 and 2.3 compared to the leveler of comparative example 2.1.

TABLE 1

| Example | Leveler EO content | COP [%] |
|---|---|---|
| Comp. 2.1 | 10 | 11.5 |
| 2.2 | 15 | 9.0 |
| 2.3 | 20 | 9.0 |

The invention claimed is:

1. A composition comprising copper ions and at least one additive comprising a polyalkyleneimine backbone comprising N-hydrogen atoms, wherein (a) the polyalkyleneimine backbone has a mass average molecular weight $M_W$ of from 900 g/mol to 100 000 g/mol, (b) the N-hydrogen atoms are each substituted by a polyoxyalkylene group comprising $C_2$ to $C_6$ oxyalkylene units, (c) the average number of oxyalkylene units in the polyoxyalkylene group is of from more than 10 to less than 30 per N-hydrogen atom in the polyalkyleneimine, and wherein the alkyleneimine is an ethyleneimine.

2. The composition according to claim 1, wherein the average number of oxyalkylene units in the polyoxyalkylene group is from 11 to 28 per N-hydrogen atom.

3. The composition according to claim 1, wherein the at least one additive is a polyalkyleneimine of formula L1

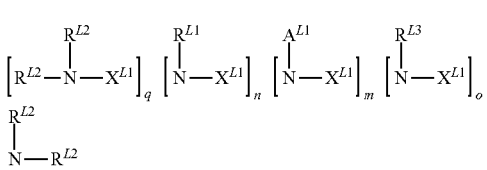

(L1)

or derivatives thereof obtainable by protonation or quaternization, wherein $X^{L1}$ is independently selected from the group consisting of ethanediyl;

$A^{L1}$ is a continuation of the polyalkyleneimine backbone by branching;

$R^{L1}$ is a polyoxyalkylene unit of formula —$(X^{L11}O)_pR^{L11}$;

$R^{L2}$ is selected from the group consisting of $R^{L1}$ and $R^{L3}$;

$R^{L3}$ is selected from the group consisting of $C_1$ to $C_{12}$ alkyl, $C_2$ to $C_{12}$ alkenyl, $C_2$ to $C_{12}$ alkynyl, $C_6$ to $C_{20}$ alkylaryl, $C_6$ to $C_{20}$ arylalkyl, and $C_6$ to $C_{20}$ aryl;

$X^{L11}$ is, for each n, independently selected from the group consisting of a $C_2$ to $C_6$ alkanediyl, propane-1,2-diyl, (2-hydroxymethyl) ethane-1,2-diyl, butane-1,2-diyl, butane-2,3-diyl, 2-methyl-propane-1,2-diyl (isobutylene), pentane-1,2-diyl, pentane-2,3-diyl, 2-methyl-butane-1,2-diyl, 3-methyl-butane-1,2-diyl, hexane-2,3-diyl, hexane-3,4-diyl, 2-methyl-pentane-1,2-diyl, 2-ethylbutane-1,2-diyl, 3-methyl-pentane-1,2-diyl, decane-1,2-diyl, 4-methyl-pentane-1,2-diyl and (2-phenyl)-ethane-1,2-diyl, and mixtures thereof;

$R^{L11}$ is each independently selected from the group consisting of hydrogen, $C_1$ to $C_{12}$ alkyl, $C_2$ to $C_{12}$ alkenyl, $C_2$ to $C_{12}$ alkynyl, $C_6$ to $C_{18}$ arylalkyl, $C_5$ to $C_{12}$ aryl, $C_2$ to $C_{12}$ alkylcarbonyl, sulfate, sulfonate and mixtures thereof;

p is an integer selected so that the arithmetic average number of oxyalkylene units in the $R^{L1}$ groups 1 to n ($1/n\Sigma_{n=1}{}^{n}p$) is a number from above 10 to below 30; and q, n, m, o are integers with the proviso that (q+n+m+o) is from 10 to 24000 and n is 1 or more.

4. The composition according to claim 3, wherein $X^{L11}$ is selected from the group consisting of ethanediyl and a combination of ethanediyl and 1,2-propanediyl.

5. The composition according to claim 3, wherein $R^{L11}$ is hydrogen.

6. The composition according to claim 3, wherein p is selected so that the arithmetic average number of oxyalkylene units in the $R^{L1}$ groups 1 to n ($1/n\Sigma_{n=1}{}^{n}p$) is a number from 11 to 28.

7. The composition according to claim 3, wherein q+n+m+o is from 15 to 10000.

8. The composition according to claim 3, wherein q+n+m+o is from 25 to 65 or from 1000 to 1800.

9. The composition according to claim 3, wherein o is 0.

10. The composition according to claim 1, wherein the average number of oxyalkylene units in the polyoxyalkylene group is from 12 to 25 per N-hydrogen atom.

11. The composition according to claim 1, further comprising one or more accelerating agents, one or more suppressing agents, or a combination thereof.

12. A method of using the composition according to claim 1, the method comprising using the composition for depositing copper on a substrate comprising a recessed feature comprising a conductive feature bottom and a dielectric feature side wall, wherein the recessed feature has an aperture size from 500 nm to 500 μm.

13. A process for electrodepositing copper on a substrate comprising a recessed feature comprising a conductive feature bottom and a dielectric feature side wall, the process comprising:

a) contacting a composition according to claim 1 with the substrate, and b) applying a current to the substrate for a time sufficient to deposit a copper layer into the recessed feature, wherein the recessed feature has an aperture size from 500 nm to 500 μm.

14. The process according to claim 13, wherein the aperture size is from 1 μm to 200 μm.

15. The composition according to claim 3, wherein $X^{L11}$ is ethane 1,2 diyl.

16. The composition according to claim 3, wherein p is selected so that the arithmetic average number of oxyalkylene units in the $R^{L1}$ groups 1 to n ($1/n\Sigma_{n=1}{}^{n}p$) is a number from 13 to 25.

17. The composition according to claim 3, wherein q+n+m+o is from 20 to 5000.

18. The composition according to claim 1, wherein the average number of oxyalkylene units in the polyoxyalkylene group is from 13 to 23 per N-hydrogen atom.

* * * * *